US011471712B2

(12) United States Patent
Thompson et al.

(10) Patent No.: US 11,471,712 B2
(45) Date of Patent: Oct. 18, 2022

(54) RESPIRATOR MASK WITH INTEGRATED BONE CONDUCTION TRANSDUCER

(71) Applicant: SCOTT TECHNOLOGIES, INC., Monroe, NC (US)

(72) Inventors: Darin Kyle Thompson, Huntersville, NC (US); Eric James Bassani, Denver, NC (US)

(73) Assignee: Scott Technologies, Inc., Monroe, NC (US)

( * ) Notice: Subject to any disclaimer, the term of this patent is extended or adjusted under 35 U.S.C. 154(b) by 870 days.

(21) Appl. No.: 16/326,002

(22) PCT Filed: Aug. 16, 2017

(86) PCT No.: PCT/US2017/047112
§ 371 (c)(1),
(2) Date: Feb. 15, 2019

(87) PCT Pub. No.: WO2018/035207
PCT Pub. Date: Feb. 22, 2018

(65) Prior Publication Data

US 2021/0331003 A1 Oct. 28, 2021

Related U.S. Application Data

(60) Provisional application No. 62/376,113, filed on Aug. 17, 2016.

(51) Int. Cl.
*A62B 18/08* (2006.01)
*A62B 18/02* (2006.01)
(Continued)

(52) U.S. Cl.
CPC ..... *A62B 18/08* (2013.01); *A62B 18/02* (2013.01); *A62B 18/04* (2013.01); *A62B 18/084* (2013.01); *H04R 1/10* (2013.01); *H04R 2460/13* (2013.01)

(58) Field of Classification Search
CPC ..... A62B 18/08; A62B 18/02; A62B 18/04; A62B 18/084; H04R 1/10; H04R 2460/13; H04R 25/606
(Continued)

(56) References Cited

U.S. PATENT DOCUMENTS 5,889,730 A 3/1999 May
9,143,848 B2 * 9/2015 Hebenstreit ..... G02B 27/017
(Continued)

FOREIGN PATENT DOCUMENTS

CN 203087593 U 7/2013
CN 203355163 U 12/2013
(Continued)

OTHER PUBLICATIONS

International Search Report for PCT International Application No. PCT/US2017/047112, dated Nov. 7, 2017, 5 pages.

*Primary Examiner* — Norman Yu

(57) ABSTRACT

A system for a bone conduction communication system that includes at least one bone conduction element that is stabilized against a wearer's head when in use. In one embodiment, the bone conduction communication system includes a bone conduction device including at least one bone conduction element and a wearable device, the bone conduction device being coupled to the wearable device, the wearable device stabilizing the at least one bone conduction element in a plurality of axes of support.

19 Claims, 11 Drawing Sheets

(51) Int. Cl.
*A62B 18/04* (2006.01)
*H04R 1/10* (2006.01)

(58) Field of Classification Search
USPC ..... 381/151, 326, 380, 367, 364, 376
See application file for complete search history.

(56) References Cited

U.S. PATENT DOCUMENTS

2003/0083112 A1* 5/2003 Fukuda ..... H04R 1/083
455/575.2
2005/0286734 A1* 12/2005 Wang ..... H04R 25/604
381/381
2009/0202084 A1* 8/2009 Joeng ..... H04R 25/30
381/60
2010/0223706 A1 9/2010 Becker
2011/0026748 A1* 2/2011 Parker ..... H04R 25/70
381/326
2011/0022448 A1 9/2011 Lee
2013/0089229 A1* 4/2013 Kristo ..... H04R 1/46
381/326
2015/0090257 A1* 4/2015 Larsen ..... A62B 9/006
128/202.22
2016/0094903 A1 3/2016 Robuchon

FOREIGN PATENT DOCUMENTS

CN 104116262 A 10/2014
CN 203935493 U 11/2014
CN 203952570 U 11/2014
CN 204193347 U 3/2015
CN 104886824 A 9/2015
WO WO 90/04908 * 5/1990
WO WO 1990-04908 5/1990
WO WO 1994/004908 5/1990
WO WO 2013-057745 4/2013

* cited by examiner

RESPIRATOR MASK WITH INTEGRATED BONE CONDUCTION TRANSDUCER

CROSS REFERENCE TO RELATED APPLICATIONS

This application is a national stage filing under 35 U.S.C. 371 of PCT/US2017/047112, filed Aug. 16, 2017, which claims the benefit of U.S. Provisional Patent Application No. 62/376,113, filed Aug. 17, 2016, the disclosures of which are incorporated by reference in their entirety herein.

TECHNICAL FIELD

The invention relates to a bone conduction communication system that includes at least one bone conduction element that is stabilized against a wearer's head when in use.

BACKGROUND

Devices based on bone conduction technology are becoming increasingly popular. These devices transmit sound from a transducer through the bones of the wearer's skull to the inner ear, rather than transmitting sound through air conduction through the outer and middle ear. Sounds delivered by this method are nearly inaudible to those other than the wearer and the sounds are also easier for the wearer to hear in noisy situations. Additionally, bone transducers may have a low profile that allows them to fit under other headgear without discomfort or inconvenience to the wearer.

These features and others make bone conduction devices particularly useful for use by first responders. For example, bone conduction devices may be used by fire fighters in situations where there is a lot of environmental noise and/or where an audio device must be easy to put on in an emergency and must fit on or under conventional personal protection equipment (PPE), such as respirator masks and the like.

Known bone conduction systems suffer from slippage where the transducers may not stay at the desired location, thus impeding effectiveness. While such slippage and misalignment may be acceptable in a recreational environment in which the wearer can easily readjust the system, such readjustment may not be readily accomplished in an emergency situation such as might occur if the wearer is a first responder.

SUMMARY

The invention advantageously provides a bone conduction communication system that includes at least one bone conduction element that is stabilized against a wearer's head when in use. In one embodiment, the bone conduction communication system includes a bone conduction device including at least one bone conduction element and a wearable device, the bone conduction device being coupled to the wearable device, the wearable device stabilizing the at least one bone conduction element in a plurality of axes of support. In an aspect of this embodiment, the at least one bone conduction element includes a first bone conduction element being coupled to a first location on the wearable device and a second bone conduction element being coupled to a second location on the wearable device. In an aspect of this embodiment, the wearable device is a respirator mask. In an aspect of this embodiment, the wearable device includes a plurality of strap coupling elements. In an aspect of this embodiment, the wearable device includes a face engagement seal, the face engagement seal including the plurality of strap coupling elements. In an aspect of this embodiment, the wearable device includes a first strap coupling element and a second strap coupling element, the first bone conduction element being coupled to the first strap coupling element and the second bone conduction element being coupled to the second strap coupling element. In an aspect of this embodiment, the first bone conduction element has a first housing with a first surface and a second surface, and the second bone conduction element has a second housing with a first surface and a second surface, the second surface of each of the first and second bone conduction element housings having a strap engagement element that protrudes from the second surface of each of the first and second bone conduction element housings. In an aspect of this embodiment, each of the first and second strap coupling elements has a first surface, a second surface, and an aperture. The first surface of the first strap coupling element is in contact with the second surface of the first bone conduction element housing such that the strap engagement element of the first bone conduction element housing extends through the aperture of the first strap coupling element, and the first surface of the second strap coupling element is in contact with the second surface of the second bone conduction element housing such that the strap engagement element of the second bone conduction element housing extends through the aperture of the second strap coupling element. In an aspect of this embodiment, the bone conduction communication system further includes a band having a first end and a second end opposite the first end, the first bone conduction element being coupled to the band first end and the second bone conduction element being coupled to the band second end. In an aspect of this embodiment, the wearable device further includes a facepiece and a facepiece seal proximate the face engagement seal, the band being located between the facepiece seal and the face engagement seal. In an aspect of this embodiment, the wearable device further includes a first strap coupling element and a second strap coupling element, at least a portion of the first bone conduction element being located within the first strap coupling element and at least a portion of the second bone conduction element being located within the second strap coupling element. In an aspect of this embodiment, the first strap coupling element defines a first pocket and the second strap coupling element defines a second pocket, the at least a portion of the first bone conduction element being located within the first pocket and the at least a portion of the second bone conduction element being located within the second pocket. In an aspect of this embodiment, the wearable device further includes a facepiece and a communication controller housing coupled to the facepiece, the communication controller housing including a communication controller, the communication controller having processing circuitry having a processor and a memory, and a communication controller transceiver having a communication unit, the communication controller being in electrical communication with the bone conduction device. In an aspect of this embodiment, at least one of the first and second bone conduction elements further includes processing circuitry having a memory and a processor, an amplifier, and a communication unit having a transceiver, the at least one of the first and second bone conduction element being in communication with the communication controller. In an aspect of this embodiment, the communication unit is a wireless communication unit.

In one embodiment, a bone conduction communication system includes a wearable device having a first strap coupling element on a first side of the wearable device and a second strap coupling element on the second side of the wearable device. The bone conduction communication system also includes a first bone conduction element. The first bone conduction element includes a first bone conduction transducer and a first processing circuitry having a memory and a processor. The first processing circuitry is in electrical communication with the first bone conduction transducer. The first bone conduction element also includes a first transceiver having a communication unit in which the first bone conduction transducer is in communication with the first processing circuitry, a first amplifier in communication with the first transceiver and the first bone conduction transducer and a first power source in communication with the first amplifier, the first transceiver, and the first processing circuitry. The bone conduction communication system includes a second bone conduction element including a second bone conduction transducer and a second processing circuitry having a memory and a processor, in which the second processing circuitry is in communication with the second bone conduction transducer. The second bone conduction element also includes a second transceiver having a communication unit in which the second transceiver is in communication with the second processing circuitry, a second amplifier in communication with the second transceiver and the second bone conduction transducer, and a second power source in communication with the second amplifier, the second transceiver, and the second processing circuitry. The bone conduction communication system also includes a band having a first end and a second end opposite the first end in which the first bone conduction element is at the first end and the second bone conduction element is at the second end. The band is coupled to the wearable device such that the first bone conduction element is coupled to the first strap coupling element and the second bone conduction element is coupled to the second strap coupling element. Each of the first and second bone conduction elements are stabilized by the band and the wearable device along a plurality of axes of support. In an aspect of this embodiment, the first bone conduction element is coupled to a first location on the wearable device and the second bone conduction element is coupled to a second location on the wearable device. In an aspect of this embodiment, the wearable device is coupled to a helmet. In an aspect of this embodiment, the wearable device includes a facepiece and a communication controller, the communication controller and the band being coupled to the facepiece. In an aspect of this embodiment, the wearable device includes a facepiece, a communication controller coupled to the facepiece, a first seal coupled to the facepiece, and a face engagement seal coupled to the facepiece proximate the first seal, the band being located between the first seal and the face engagement seal.

In one embodiment, a bone conduction communication system includes a wearable device including a facepiece, a communication controller, the communication controller having a processing circuitry, the processing circuitry having a processor and a memory, and a face engagement seal coupled to the facepiece, the face engagement seal including a strap coupling element, and at least one bone conduction transducer within the strap coupling element the at least one bone conduction transducer being stabilized by the strap coupling element along a plurality of axes of support, the at least one bone conduction transducer configured for electrical communication with the communication controller. In an aspect of this embodiment, the bone conduction communication system further includes a helmet configured to be worn on a wearer's head, the at least a portion of the wearable device being configured to be located between the helmet and the wearer's head. In an aspect of this embodiment, the at least one bone conduction transducer includes a first bone conduction transducer and a second bone conduction transducer, at least one of the first and second bone conduction transducers being electrically coupled to a transceiver, the transceiver being in wireless communication with the communication controller. In an aspect of this embodiment, the strap coupling element defines a pocket, the at least one bone conduction transducer being located within the strap coupling element pocket.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
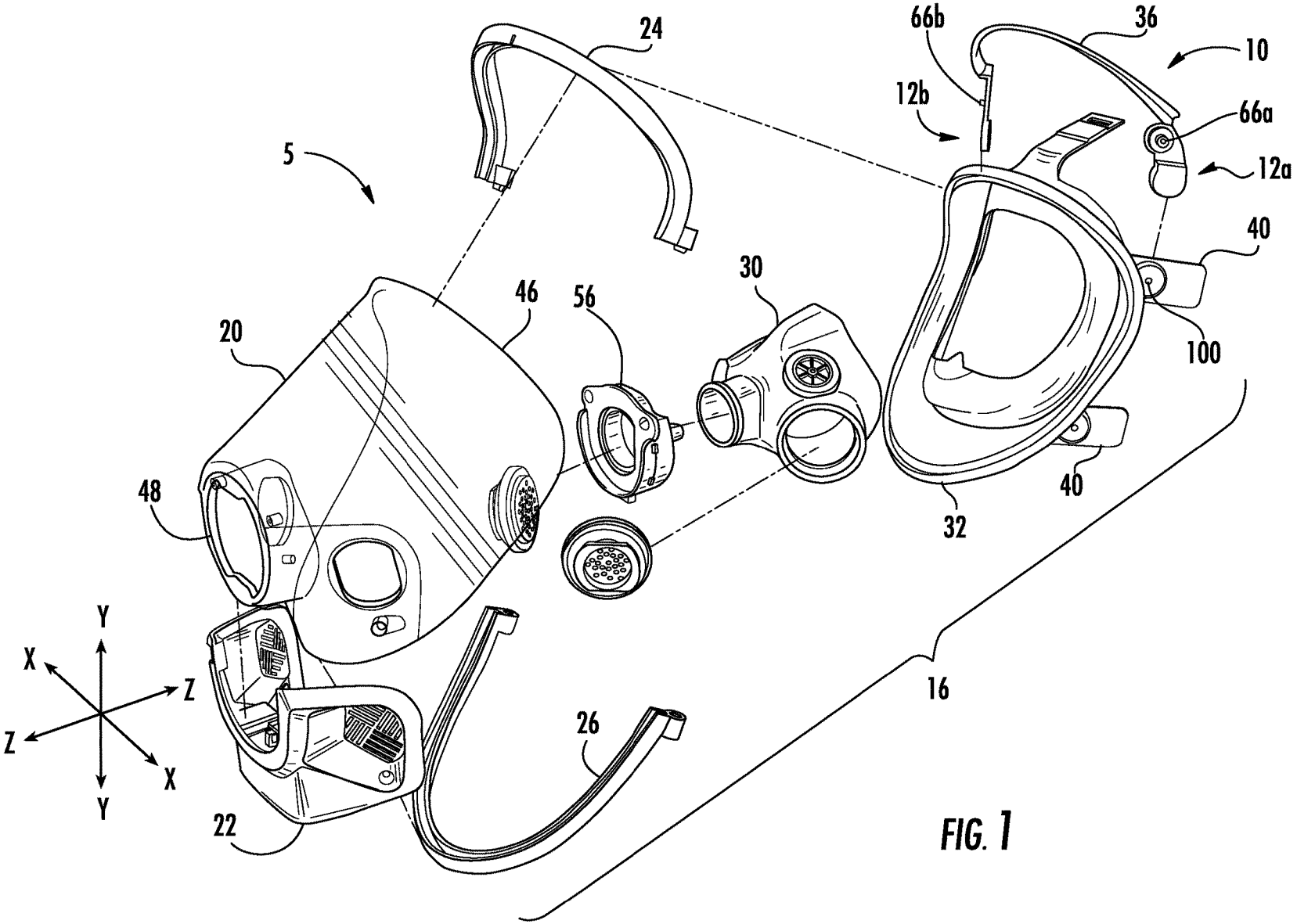
FIG. 1 shows an exploded view of a first embodiment of a bone conduction system, the bone conduction device including a wireless connection between a bone conduction element and a communication controller.

The invention advantageously provides a bone conduction communication system that includes at least one bone conduction element that is stabilized against a wearer's head when in use. For example, the bone conduction system includes at least one bone conduction element that is assembled onto or into a wearable device, such as a respirator mask. The wearable device stabilizes the at least one bone conduction element in multiple axes of support (for example, in at least two of the x-axis, the y-axis, and the z-axis). In one embodiment, the wearable device stabilizes the at least one bone conduction element in all three axes of support (x, y and z axes). In one embodiment, the bone conduction device includes a band coupled to the at least one bone conduction element, and the band is coupled to the wearable device, such as between two seals in the wearable device. Alternatively, the wearable device includes a pocket or defines a housing for each of the at least one bone conduction element. Further, the wearable device includes straps that are directly coupled to the at least one bone conduction element. In this manner, the at least one bone conduction element is stabilized against the wearer's head by the secured band and/or by the attachment of the straps.

Before describing in detail exemplary embodiments that are in accordance with the disclosure, it is noted that components have been represented where appropriate by conventional symbols in drawings, showing only those specific details that are pertinent to understanding the embodiments of the disclosure so as not to obscure the disclosure with details that will be readily apparent to those of ordinary skill in the art having the benefit of the description herein.

As used herein, relational terms, such as "first," "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Referring now to the drawing figures in which like reference designations refer to like elements, an embodiment of a bone conduction system constructed in accordance with the principles of the invention is shown in the figures and generally designated as "5." The bone conduction communication system 5 shown in FIGS. 1-8 generally includes a bone conduction device including a first bone conduction element and a second bone conduction element. Although embodiments described and depicted herein show two bone conduction elements, it is understood that implementations are not limited to only two bone conduction elements. It is understood that a single bone conduction element, e.g., transducer and housing, may be implemented. Likewise, more than two bone conduction elements may be implemented and positioned at different locations on the wearer's head.

Referring now to FIG. 1, an exploded view of a first embodiment of a bone conduction communication system 5 is shown. As a non-limiting example, bone conduction device 10 includes at least one bone conduction element 12 coupled to a wearable device 16. For example, the bone conduction device 10 includes a first bone conduction element 12*a* and a second bone conduction element 12*b*. The wearable device 16 may be a respirator mask such as may be worn by a first responder in an emergency situation, and includes a facepiece 20, a communication controller housing 22, one or more facepiece seals, such as an upper facepiece (or first) seal 24 and a lower facepiece (or second) seal 26, a nosecup 30, a face engagement seal 32, and one or more filters, respirators, and/or other mask components. In the first embodiment shown in FIGS. 1-3, the bone conduction device 10 includes at least one bone conduction element 12 coupled to a band 36, and the at least one bone conduction element 12 and band 36 is coupled to the wearable device 16 such that the band 36 is secured between the face engagement seal 32 and upper facepiece seal 24 and the at least one bone conduction element 12 is held against a wearer's face by one or more strap coupling elements 40. However, it will be understood that the wearable device 16 may include more or fewer components than those shown in FIG. 1. For example, in one embodiment, the wearable device 16 does not include a face engagement seal 32 or optionally an upper facepiece seal 24, lower facepiece seal 26 and/or nosecup 30, but does include one or more straps or harnesses to mount the bone conduction communication system 5 to a wearer's head (for example, in embodiments in which the wearable device 16 is a loose-fitting head top mask). In this configuration, the band 36 may be coupled directly to the facepiece 20 and/or to other components of the bone conduction communication system 5.

The wearable device 16 is configured to be worn by a wearer, such as first responder, in environments where the wearer is exposed to hazardous materials, such as fire, smoke, gases, vapors, aerosols, biological agents, and/or the like. Consequently, the mask includes a facepiece 20 sized to fit over all or part of a wearer's face. For example, the facepiece 20 is sized to cover the wearer's eyes, nose, and mouth. Alternatively, the facepiece 20 may be sized to cover only the wearer's nose and mouth. The facepiece 20 is composed of transparent or translucent materials commonly used for respirator mask facepieces. The facepiece 20 defines an interior and further includes an interior surface and an exterior surface opposite the interior surface. Optionally, the facepiece 20 includes a proximal end 46 that is closer to the wearer when the mask is donned, and a distal end 48 that is farther from the wearer when the mask is donned. The wearable device 16 also includes an aperture 50 that is sized and configured to receive at least a portion of an air regulator (not shown). The aperture 50 may be defined by the facepiece, the communication controller housing, and/or other components of the mask. As a non-limiting example, the regulator may be an air-purifying regulator (APR), a supplied-air/self-contained breathing apparatus (SCBA), powered air-purifying regulator (PAPR), or regulators and/or filters for chemical, biological, radiological, and nuclear defense (CBRN defense). Further, although not shown, the bone conduction communication system 5 may be configured for use with other types of personal protective equipment. In one embodiment, the wearable device 16 is sized and configured to be worn under a cap and a helmet of a first responder. In one embodiment, the wearable device 16 is coupled to, or is configured to be coupled to, personal protection equipment such as a helmet and/or a cap. Embodiments are not limited to respirators with face seals. It is contemplated that other embodiments, such as respirators that do not include face seals but that use head harness components can be used.

The one or more facepiece seals 24, 26, nosecup 30, and face engagement seal 32 is composed of flexible, hypoallergenic materials such as rubber (for example, ethylene propylene diene monomer (EPDM) rubber and/or latex-free polyisoprene), and/or silicone. The nosecup 30 is located within the interior of the facepiece 20 and in contact with the wearer's face when the mask is donned. The facepiece seals 24, 26 provide a smooth interface between the edges of the faceplate and the face engagement seal. The face engagement seal 32, in turn, provides a smooth and fluid-tight seal around the wearer's face. Further, the face engagement seal 32 includes a plurality of strap coupling elements 40. The mask further includes a plurality of straps 54 that are coupled to the strap coupling elements 40 (for example, a first strap coupling element 40*a* and a second strap coupling element 40*b*) of the face engagement seal 32. Alternatively, the straps 54 may be coupled to component of the wearable device 16 other than the face engagement seal 32. In one embodiment, the straps 54 are configured to be coupled to one or more items of personal protective equipment, such as a helmet and/or cap. The straps 54 may be composed of materials such as nylon, textile polyester, rubber, and/or KEVLAR® (E. I. du Pont de Nemours and Company, Delaware).

The communication controller housing 22 is mounted to a portion of the facepiece 20, such as the distal end 48 of the facepiece 20. Optionally, the communication controller housing 22 also includes a coupling plate 56 that securely couples the communication controller housing 22 to the facepiece 20. Together, the communication controller housing 22, coupling plate 56, and facepiece 20 may provide a docking port 58 to which a regulator may be coupled and thus put into fluid communication with the nosecup 30. However, it will be understood that the communication controller housing 22 may be at any location on the mask. The communication controller housing 22 contains a controller, as is discussed in more detail below with respect to FIGS. 10 and 11.

Figure 2:
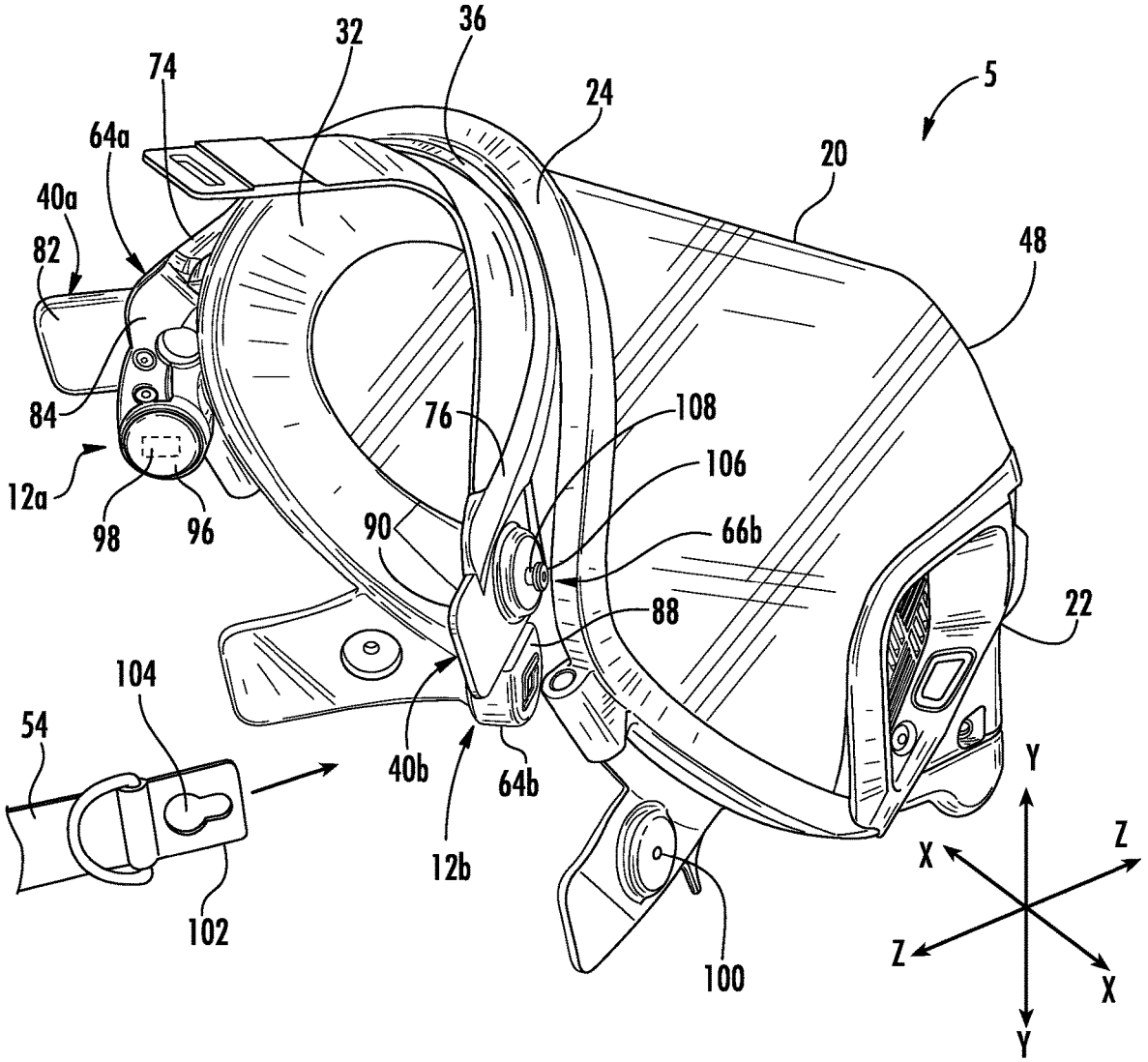
FIG. 2 shows a rear perspective view of the first embodiment of the bone conduction system.
Figure 3:
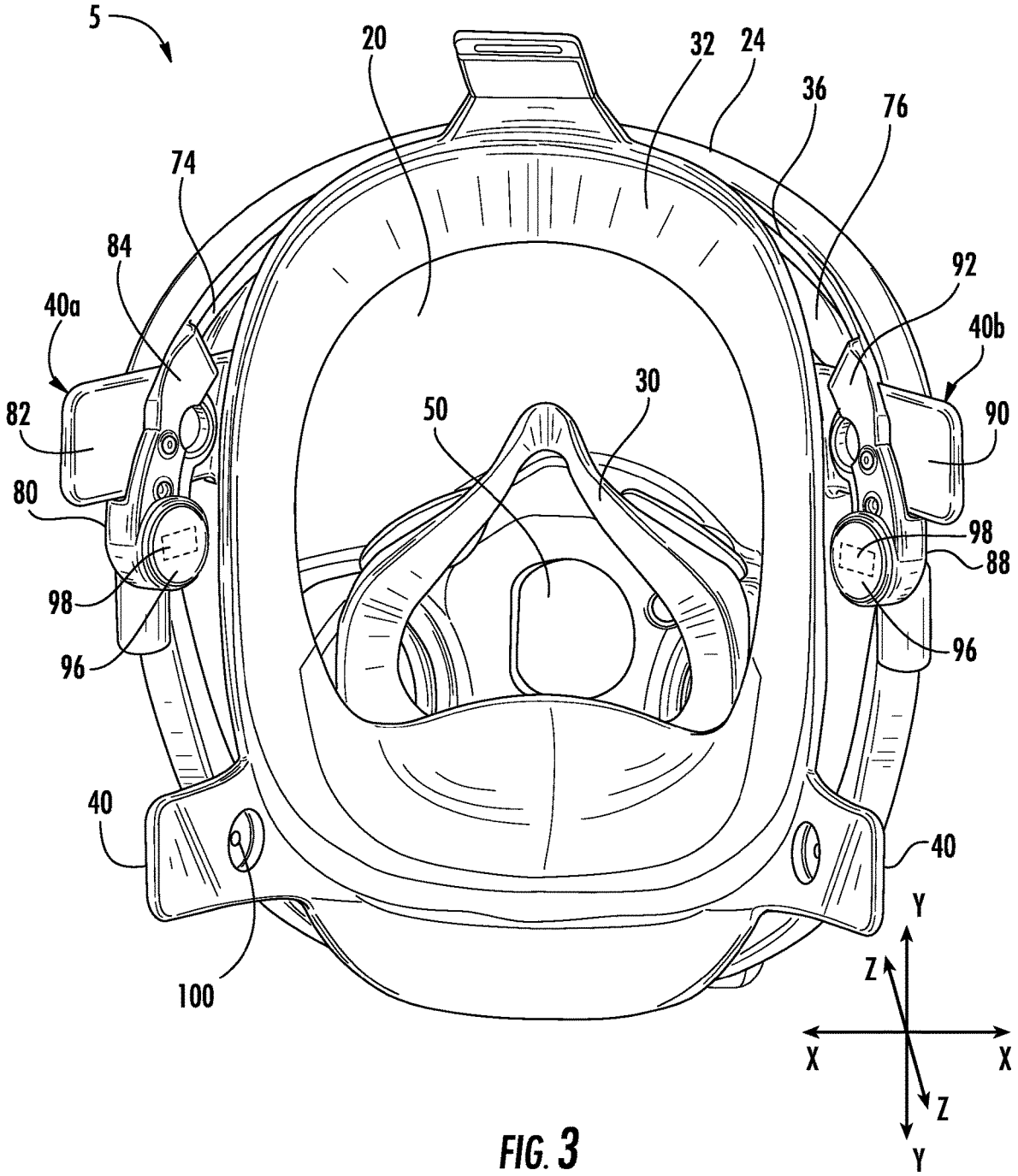
FIG. 3 shows a rear view of the first embodiment of the bone conduction system.

Referring now to FIGS. 1-3, the first embodiment of the bone conduction communication system 5 includes a bone conduction device 10 including at least one bone conduction element 12 coupled to a band 36. As noted above, although two bone conduction elements 12*a*, 12*b* are shown in the drawings, it will be understood that the mask may include any number of bone conduction elements. For example, the bone conduction device 10 may include a first bone conduction element 12*a* and a second bone conduction element 12*b* coupled by a band 36. However, any number of bone conduction elements may collectively be referred to as "bone conduction element 12." Each bone conduction element 12 includes a bone conduction element housing 64 having a strap engagement element 66 and housing a transducer in which the transducer is arranged to vibrate to impart a corresponding mechanical vibration onto a wearer's facial and/or head bones to allow the wearer to hear the sound waves corresponding to the vibration of the transducer. For example, the bone conduction device 10 includes a first bone conduction element 12*a* including a housing 64*a* having a first strap engagement element 66*a* and a second bone conduction element 12*b* including a housing 64*b* having a second strap engagement element 66*b*. The band 36 is sized and configured such that it fits between the upper facepiece seal 24 and an upper portion of the face engagement seal 32, while still allowing the fluid-tight seal of the mask to be maintained. For example, the band 36 may be curved to match a curve of the upper facepiece seal 24 and upper portion of the face engagement seal 32. Alternatively, the band 36 may not be curved, but may instead be composed of a material, such as silicone, that is flexible enough to allow the band to conform to the space between the seals 24, 32. The band 36 includes a first end 74 and a second end 76 opposite the first end 74, at least one of the first 74 and second 76 ends being coupled to a bone conduction element 12. For example, the bone conduction device 10 may include a band 36 having first end 74 that is coupled to a first bone conduction element housing 64*a* and a second end 76 opposite the first end 74 that is coupled to a second bone conduction element housing 64*b*. Alternatively, the band 36 and the bone conduction element housing(s) 64 may be integrated into a single component during manufacturing. For example, the band 36 and the bone conduction element housing(s) 64 may be molded as a single piece. The bone conduction element housing(s) 64 and the band 36 are composed of a rigid or semi-rigid material, such as a plastic. Optionally, the band 36 may be less rigid than the bone conduction element housings 64, i.e., the band 36 may be of a lower durometer than the bone conduction elements housing(s) 64. Further, one or more wires, bone conduction element components, and/or communication components may be housed within the band 36 and be in communication with the bone conduction element(s) 12.

An outer surface of each bone conduction element housing is in contact with an inner surface of an adjacent strap coupling element, such that an inner surface of the bone conduction housing is in contact with the sides of the wearer's face when the mask is donned. As a non-limiting example, the outer (or second) surface 80 of the first bone conduction element housing 64*a* is in contact with an inner (or first) surface 82 of the first strap coupling element 40 and the inner (or first) surface 84 of the first bone conduction element housing 64*a* is in contact with the wearer's right temple. Similarly, the outer (or second) surface 88 of the second bone conduction element housing 64*b* is in contact with an inner (or first) surface 90 of the second strap coupling element 42 and the inner (or first) surface 92 of the second bone conduction element housing 64*b* is in contact with the wearer's left temple. Each bone conduction element housing 64 includes a transducer area 96 that is proximate a bone conduction transducer 98 within the housing.

Further, the outer surface 80, 88 of each bone conduction element housing 64 includes a protruding strap engagement element 66 that extends a distance from the outer (or second) surface 80, 88 of the bone conduction element housing 64. Each strap coupling element 40 includes an aperture 100 sized and configured such that a corresponding strap engagement element 66 extends outward through, and a distance beyond, the strap coupling element aperture 100 (as shown in FIG. 2). Each strap 54 includes a keyhole bracket 102 having a keyhole-shaped aperture 104 that can fit over and be secured to the strap engagement element 66 as is currently known. For example, each strap engagement element 66 may include a head portion 106 and a neck portion 108, with the neck portion 108 having a smaller width or diameter than the head portion 106 in some embodiments. The keyhole-shaped aperture 104 may have a wider portion that is sized to fit over the head portion 106 of the strap engagement element 66 and a narrower portion that is sized to fit only over the neck portion 108. Thus, sliding the keyhole bracket 102 until the narrower portion fits over the neck portion, such as when the straps 54 are tightened, 108 will lock the brackets 102 to the strap engagement element 66, and therefore the strap 54 to the wearable device 16. However, it will be understood that any suitable coupling means may be used. Thus, the straps 54 may be secured to the face engagement seal 32, and therefore to the wearable device 16, by being coupled to the first and second bone conduction element housings 64*a*, 64*b*. Alternatively, the straps 54 may be secured directly to the face engagement seal 32 and/or other portion of the wearable device 16.

During use, the wearable device 16 therefore stabilizes each bone conduction element 12 in several axes of support. The bone conduction element(s) 12 is stabilized along an x-axis that extends from the right side to the left side of the wearer's head, a y-axis that extends from the wearer's chin to the top of the wearer's head, and a z-axis that extends from the back of the wearer's head to the front of the wearer's head. For example, the band 36 and its location between the upper facepiece seal 24 and the face engagement seal 32 prevents the bone conduction element(s) 12 from falling down the wearer's face toward the wearer's chin (i.e., stabilizes the bone conduction element(s) along the y-axis), prevents the bone conduction element(s) 12 from moving side to side relative to the wearer's face (i.e., stabilizes the bone conduction element(s) along the x-axis), and prevents the bone conduction element(s) 12 from moving toward the front of the wearer's face (i.e., stabilizes the bone conduction element(s) along the z-axis). Further, the extension of the strap engagement element(s) 66 and/or the pressure exerted on the bone conduction element housing(s) 64 against the wearer's face by the straps 54 similarly stabilizes the bone conduction element(s) 12 along the x-axis, y-axis, and z-axis. In other words, the straps 54 not only hold the wearable device to the wearer's head, but they also allow the bone conduction element housing(s) 64 to remain firmly positioned against the wearer's head.

Each bone conduction element 12 includes a bone conduction transducer 98. Unlike traditional audio speakers, the bone conduction transducer 98 does not include a moving cone and may, in one non-limiting example, instead include a metal rod wrapped with a coil. However, it will be understood that the transducer may have any configuration that allows it to convert electrical signals to mechanical vibrations that are sent through the rod and coil from a power source.

Figure 10:
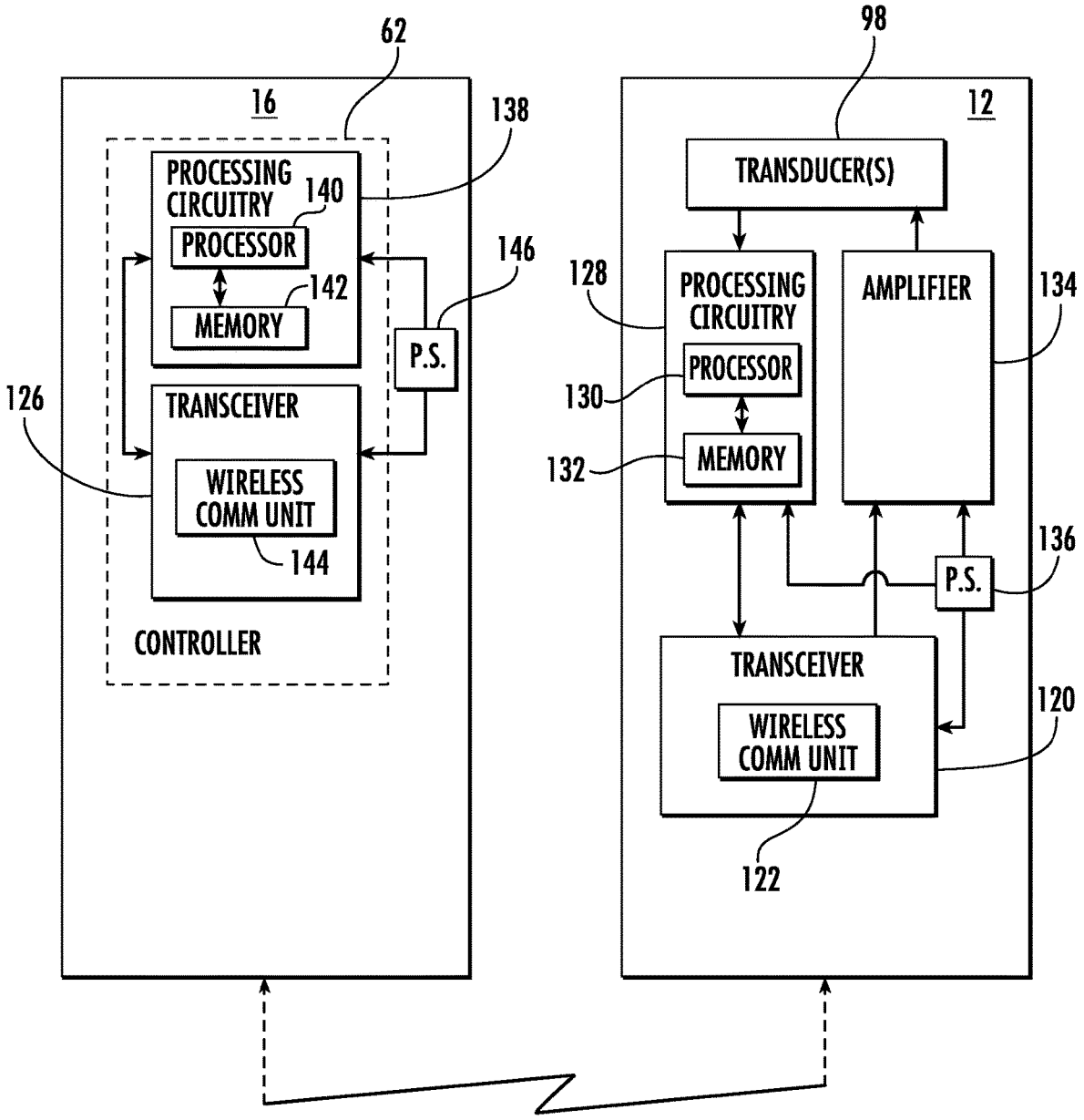
FIG. 10 is a block diagram of electronic components to provide a wireless connection between a bone conduction device and a communication controller.

As shown in FIGS. 1-3, the bone conduction element(s) 12 is in wireless communication with the communication controller 62, which configuration is shown and described in greater detail in reference to FIG. 10. Even though the bone conduction element(s) 12 is in wireless communication with the communication controller 62, the communication controller 62 may nonetheless optionally include a physical interface for the wired connection of one or more system components and/or peripheral devices. In one embodiment, one or more bone conduction elements 12 serve as microphones to pick up the wearer's voice for transmission to others. In such case, the bone conduction element 12 operates bidirectionally to capture wearer audio and transmit the captured audio to the wearable device 16, and to vibrate to allow the wearer to hear audio received from the wearable device 16.

Figure 4:
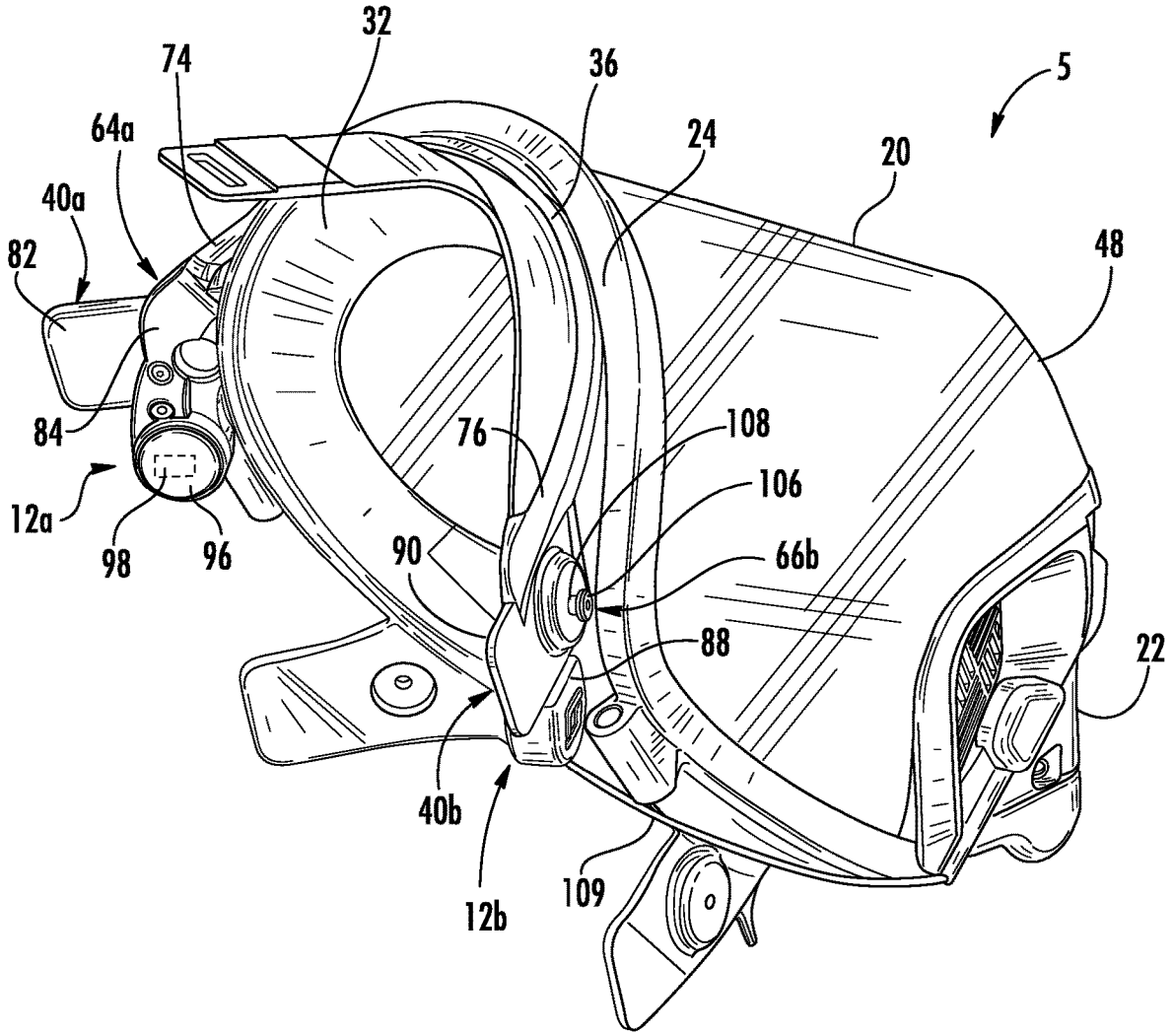
FIG. 4 shows a rear perspective view of a second embodiment of the bone conduction system, the bone conduction device including a wired connection between a bone conduction element and a communication controller.
Figure 5:
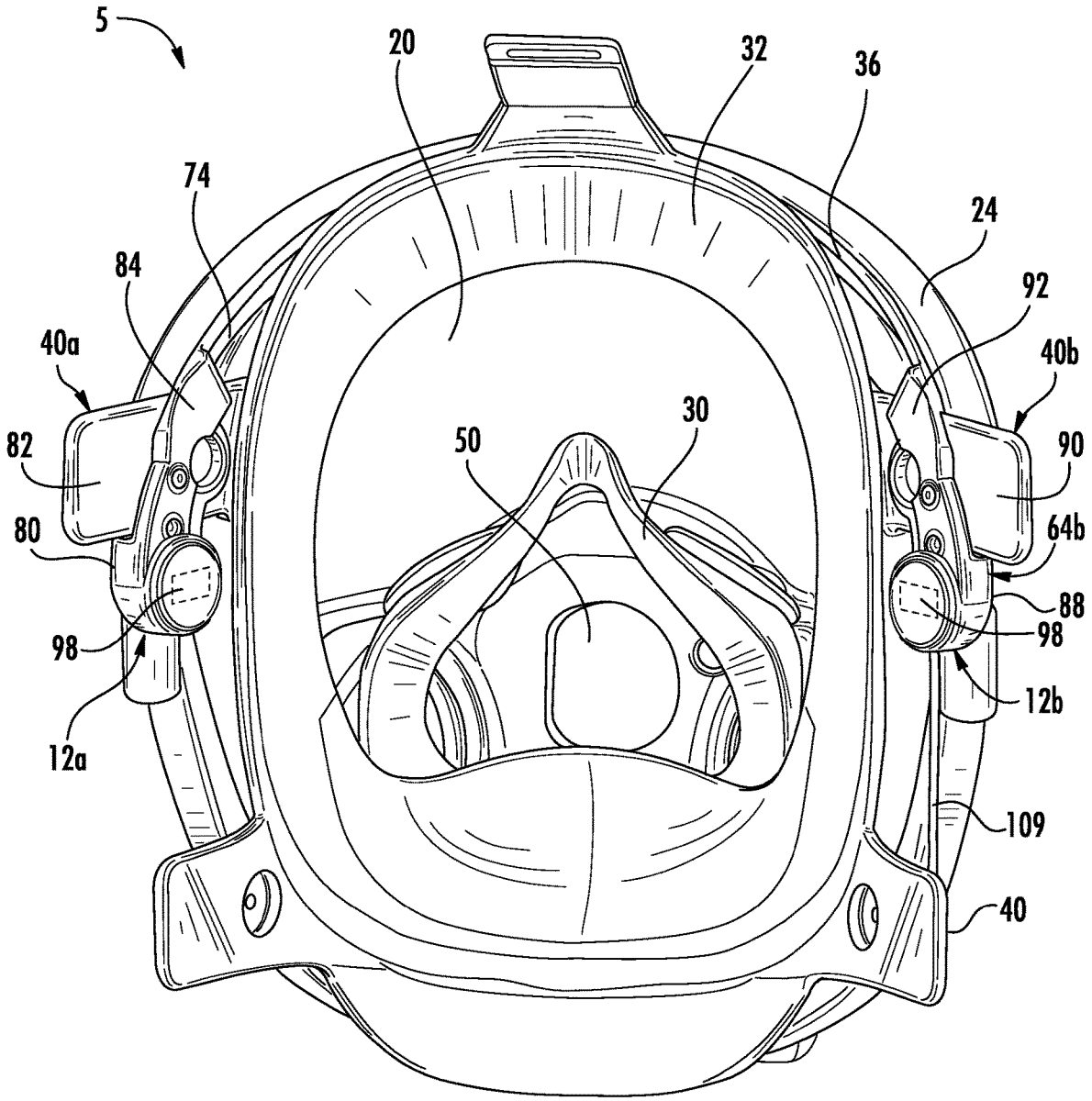
FIG. 5 shows a rear view of the second embodiment of the bone conduction system.

Referring now to FIGS. 4 and 5, a second embodiment of a bone conduction system is shown. The second embodiment of the bone conduction communication system 5 shown in FIGS. 4 and 5 is similar to the first embodiment of the bone conduction communication system 5 shown in FIGS. 1-3, except that the bone conduction element(s) 12 is in wired communication with the communication controller 62, which configuration is shown and described in greater detail in reference to FIG. 11. In this configuration, the bone conduction device includes a connector 109 that is removably connectable between an interface 110 in one or more bone conduction element 12 and a communication controller housing interface 112. The interfaces 110, 112 and connector 109 are removably connectable using known interface configurations, such as USB connections, pogo pin connections, or the like suitable for transmission of electrical signals between the bone conduction device and the communication controller.

Figure 6:
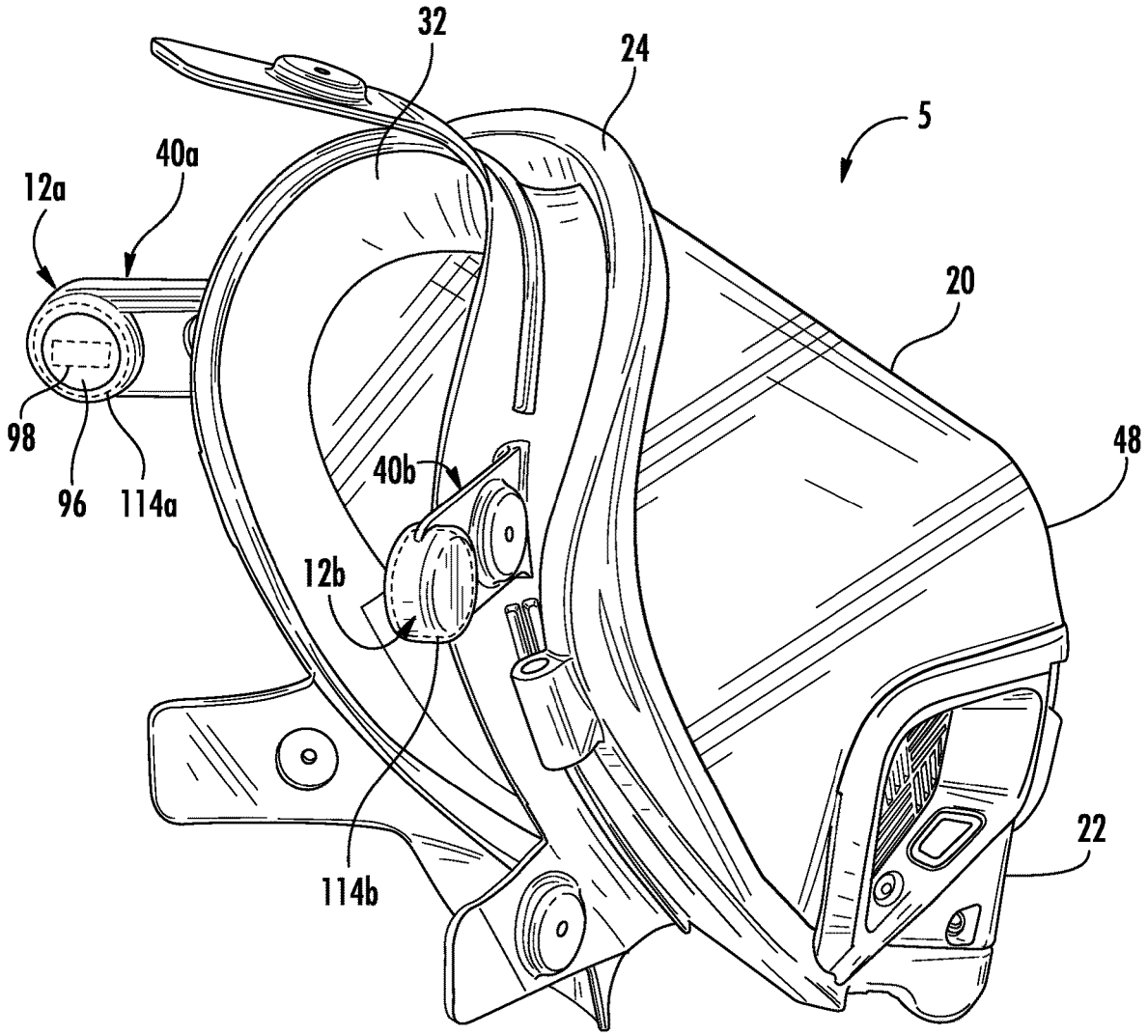
FIG. 6 shows a rear perspective view of a third embodiment of a bone conduction system, the bone conduction device including a wireless connection between a bone conduction element and a communication controller.
Figure 7:
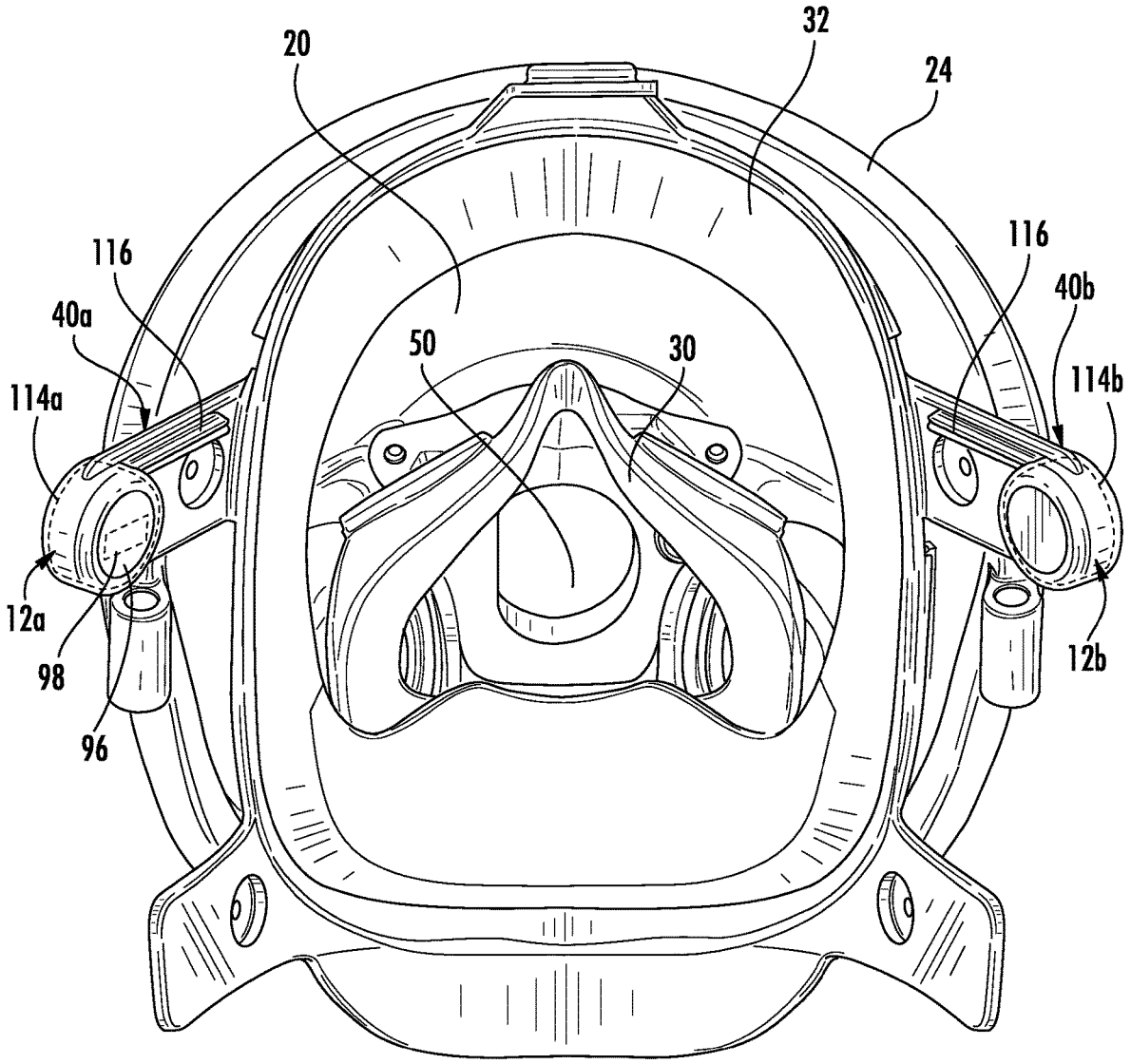
FIG. 7 shows a rear view of the third embodiment of the bone conduction device.

Referring now to FIGS. 6 and 7, a third embodiment of a bone conduction communication system 5 is shown. The bone conduction device 10 includes at least one bone conduction element 12 coupled directly to a portion of the wearable device 16. Although two bone conduction elements 12*a*, 12*b* are shown in the drawings, it will be understood that the mask may include any number of bone conduction elements. As a non-limiting example, the bone conduction device 10 may include a first bone conduction element 12*a* and a second bone conduction element 12*b*. Each bone conduction element 12*a*, 12*b* includes a housing 64*a*, 64*b*, or the strap coupling element 40 defines a housing that contains the components of the corresponding bone conduction element 12*a*, 12*b*. In case, each bone conduction element 12*a*, 12*b* fits into a corresponding pocket 114 that is integrated into the corresponding strap coupling element 40*a*, 40*b*. For example, the bone conduction device 10 may include a first bone conduction element housing 64*a* that fits into a first pocket 114*a* within the first strap coupling element 40 and a second bone conduction element housing 64*b* that fits into a second pocket 114*b* within the second strap coupling element 42. The pocket 114 is shown in dashed lines in FIGS. 6 and 7, and it will be understood that the bone conduction element 12 is located within the pocket 114. In other words, the bone conduction element 12 components, including the bone conduction transducer 98, are not visible because they are within the strap coupling element 40. Each strap coupling element optionally includes a reinforcement element 116 that helps the strap coupling element 40 maintain its shape and configuration against the wearer's face. Additionally, although not shown, each bone conduction element housing 64 may include a strap engagement element 66, as shown and described in FIGS. 1-5. Alternatively, each bone conduction element housing 64 may not include a strap engagement element 66, and the face engagement seal 32 may include strap engagement elements on each of the strap coupling elements. Alternatively, the straps 54 may attach directly to the facepiece or other mask component.

Further, the bone conduction communication system 5 shown in FIGS. 6 and 7 is similar to the bone conduction communication system 5 shown in FIGS. 1-3, except that the bone conduction device shown in FIGS. 6 and 7 does not include a band 36. However, the configuration of the bone conduction element(s) 12 relative to the strap coupling elements 40 still stabilizes the bone conduction element(s) 12 in the x-axis, y-axis, and z-axis, as described above. For example, the pressure exerted on the first and second bone conduction element housings 64*a*, 64*b* against the wearer's face by the straps 54 stabilizes the bone conduction device along the x-axis, y-axis, and z-axis. All other features of the wearable device 16 are as shown and described in FIGS. 1-3.

During use, the wearable device 16 stabilizes the bone conduction element(s) 12 in several axes of support. The bone conduction element(s) 12 are stabilized along an x-axis that extends from the right side to the left side of the wearer's head, a y-axis that extends from the wearer's chin to the top of the wearer's head, and a z-axis that extends from the back of the wearer's head to the front of the wearer's head. For example, the extension of the strap engagement elements 66*a*, 66*b* of the first 64*a* and second 64*b* bone conduction housings, respectively, and/or the pressure exerted on the first 64*a* and second 64*b* bone conduction housings against the wearer's face by the straps 54 stabilize the bone conduction element(s) along the x-axis, y-axis, and z-axis.

Like the embodiment shown in FIGS. 1-3, the third embodiment of the bone conduction device 10 shown in FIGS. 6 and 7 includes bone conduction element(s) 12 that are in wireless communication with the communication controller 62, which configuration is shown and described in greater detail in reference to FIG. 10. Even though the bone conduction element(s) 12 are in wireless communication with the communication controller 62, the communication controller 62 may nonetheless optionally include a physical interface 112 for the wired connection of one or more system components and/or peripheral devices.

Figure 8:
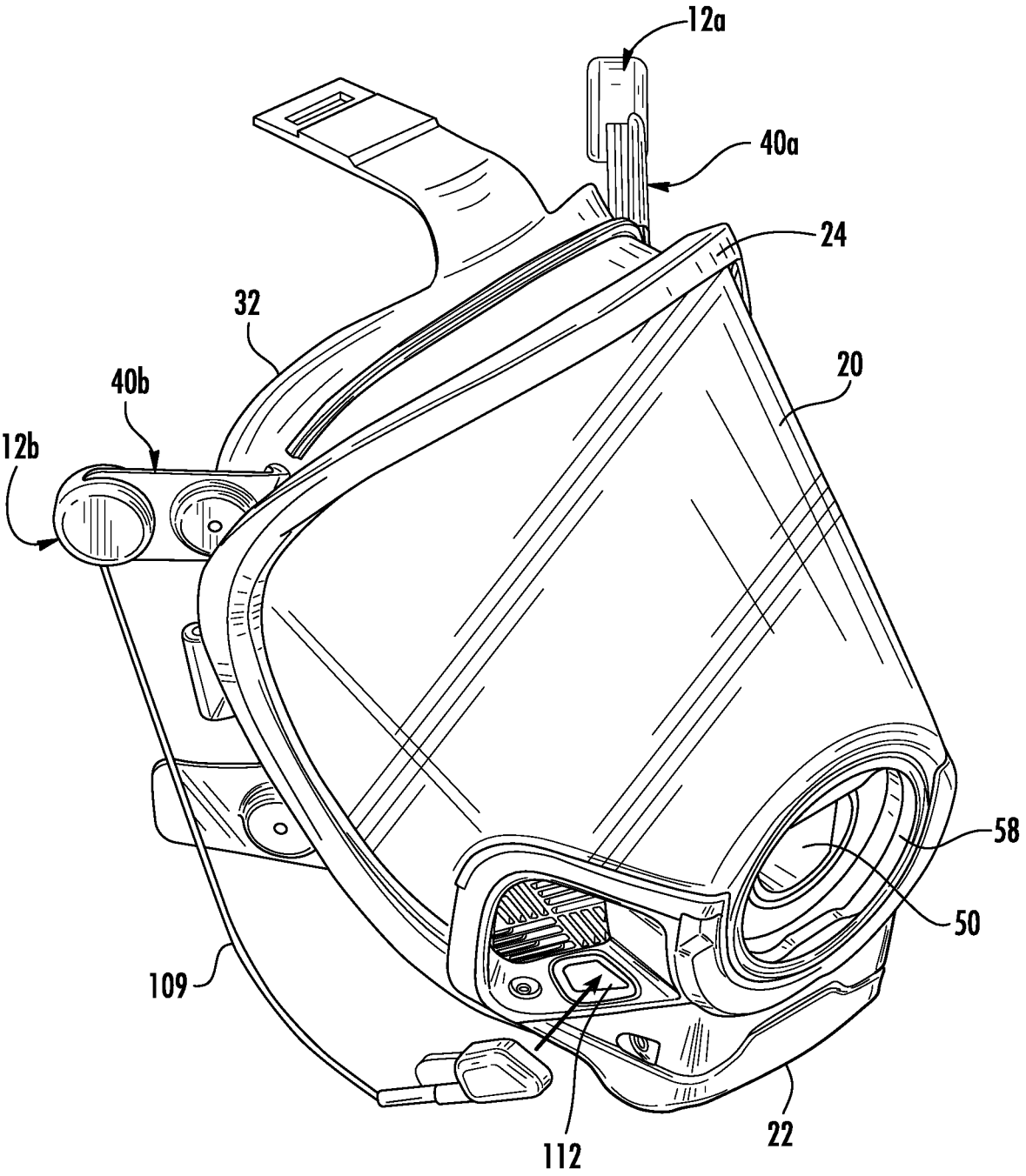
FIG. 8 shows a rear perspective view of a fourth embodiment of the bone conduction device, the bone conduction device including a wired connection between a bone conduction element and a communication controller.
Figure 9:
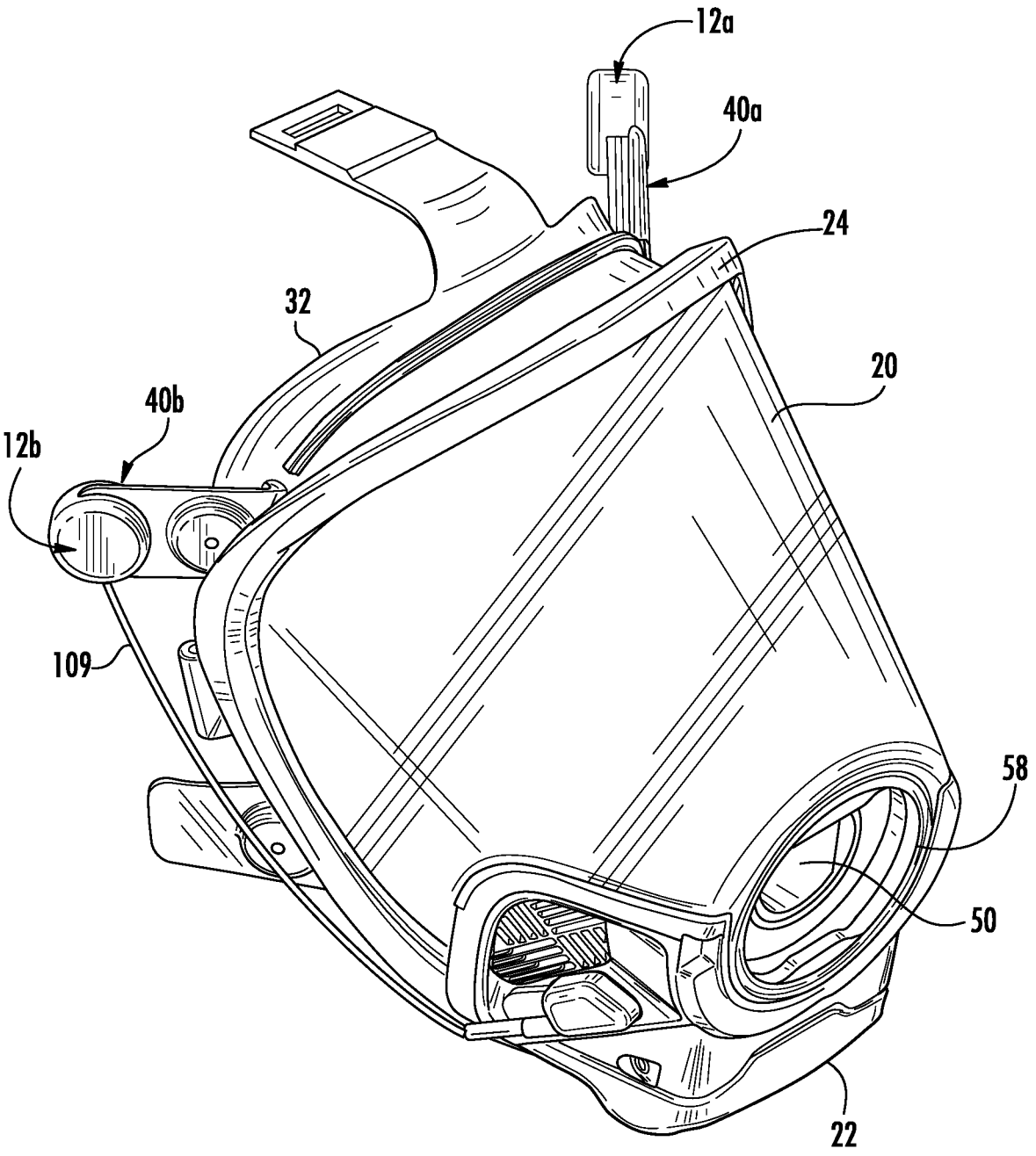
FIG. 9 shows a rear view of the fourth embodiment of the bone conduction device.

Referring now to FIGS. 8 and 9, a fourth embodiment of a bone conduction device is shown. The fourth embodiment of the bone conduction device 10 shown in FIGS. 8 and 9 are similar to the third embodiment of the bone conduction device 10 shown in FIGS. 6 and 7, except that the bone conduction element(s) 12 are in wired communication with the communication controller 62, which configuration is shown and described in greater detail in reference to FIG. 11. In this configuration, the bone conduction device 10 includes a connector 109 that is removably connectable between the interface 110 in one or more of the bone conduction elements 12 and the communication controller housing interface 112. The interfaces 110, 112 and connector 109 are removably connectable using known interface configurations, such as USB connections, pogo pin connections, or the like suitable for transmission of electrical signals between the bone conduction device and the communication controller.

Referring now to FIG. 10, a schematic view of a wireless connection between a bone conduction element 12 and the communication controller 62 in the wearable device 16 is shown. The embodiment of FIG. 10 can support bidirectional communication between the wearable device 16 and the bone conduction element 12. Each bone conduction element 12 includes a bone conduction transducer 98.

In in one embodiment, each bone conduction element 12 further includes a transceiver 120 having a wireless communication unit 122. The transceiver 120 receives and transmits signals and is configured to operate in a half duplex mode or a full duplex mode via the wireless communication unit 122 with the wireless communication unit 144 in the bone conduction element transceiver 120 in the communication controller 62. For example, the transceiver 120 transmits and receives signals to and from a communication controller transceiver 126 in the communication controller 62 via a wireless communication technology such as BLUETOOTH, infra-red, Zigbee, near field communication (NFC), WiFi, etc. It is understood that implementations are not limited to only these technologies and that any wireless communication technology suitable for short-range communications can be used.

In one embodiment, each bone conduction element 12 also includes processing circuitry 128 having a processor 130 and a memory 132. The memory 132 is in electrical communication with the processor 130 and has instructions that, when executed by the processor 130, configure the processor 130 to receive electrical signals corresponding to mechanical vibrations received from the bone conduction transducer 98 such as might occur when the wearer speaks. In one embodiment, each bone conduction element 12 further includes an amplifier 134 and a power source 136 in communication with the processing circuitry 128, the transceiver 120, and the amplifier 134. The power source may be a battery, inductive power source or any other device capable of powering the electronic components of the bone conduction element 12.

In one embodiment, the amplifier 134 amplifies the signal received by transceiver 120 to stimulate, i.e., drive, the bone conduction transducer 98, allowing the transducer to vibrate in accordance with the signal so that the wearer can hear the audio via bone conduction. In other words, the amplified signal is converted to mechanical vibrations, which are passed through the wearer's skull bones to the inner ear. Although processing circuitry 128, amplifier 124 and transceiver 120 are shown as separate elements, it is understood that one or more of these elements can be implemented in a single physical package.

In addition to a traditional processor and memory, processing circuitry 128 may include integrated circuitry for processing and/or control, e.g., one or more processors and/or processor cores and/or FPGAs (Field Programmable Gate Array) and/or ASICs (Application Specific Integrated Circuitry).

Processing circuitry 128 may comprise and/or be connected to and/or be configured for accessing (e.g., writing to and/or reading from) memory 132, which may comprise any kind of volatile and/or non-volatile memory, e.g., cache and/or buffer memory and/or RAM (Random Access Memory) and/or ROM (Read-Only Memory) and/or optical memory and/or EPROM (Erasable Programmable Read-Only Memory). Such memory 132 may be configured to store code executable by control circuitry and/or other data, e.g., data pertaining to communication, e.g., configuration and/or address data of nodes, etc. Processing circuitry 128 may be configured to control any of the methods described herein and/or to cause such methods to be performed, e.g., by processor 130. Corresponding instructions may be stored in the memory 132, which may be readable and/or readably connected to the processing circuitry 128. In other words, processing circuitry 128 may include a controller, which may include a microprocessor and/or microcontroller and/or FPGA (Field-Programmable Gate Array) device and/or ASIC (Application Specific Integrated Circuit) device. It may be considered that processing circuitry 128 includes or may be connected or connectable to memory, which may be configured to be accessible for reading and/or writing by the controller and/or processing circuitry 128.

Of note, although the embodiments described above refer to the processing circuitry 128, the amplifier 134, the transceiver 120 and the power supply 136 as being included in each bone conduction element 12, it is contemplated that only a single bone conduction element 12 need include these elements. For example, in one embodiment, the electrical components are included in only a single bone conduction element 12 while other bone conduction elements 12 can be wired to the bone conduction element 12 that includes the electronic circuitry. In another embodiment, the processing circuitry 128, the amplifier 134, the transceiver 120 and the power source 136 are included in an enclosure that is separate from the bone conduction unit, and electrically coupled to the bone conduction element(s) 12 by a wire or other signal carrying medium sufficient to drive the bone conduction transducer(s) 98.

In the case where the bone conduction unit will only receive signals from the communication controller 62 in the wearable device 16, i.e., unidirectional operation only, the processing circuitry 128 is optional and can be omitted.

In one embodiment, the communication controller housing 22 includes a communication controller 62 that includes processing circuitry 138 having a processor 140 and a memory 142. The memory 142 is in communication with the processor 140 and stores instructions that, when executed by the processor 140, configure the processor 140 to provide communications between the communication controller 62 and other devices such as the bone conduction element 12. The communication controller 62 also includes a communication controller transceiver 126 having a wireless communication unit 144. The communication controller transceiver 126 wirelessly receives and transmits signals and is operable in a half duplex mode or a full duplex mode. In one embodiment, the communication controller transceiver 126, via the wireless communication unit 144 transmits and receives signals to and from the bone conduction element transceiver 120. In one embodiment, the communication controller transceiver 126 also wirelessly receives audio signals from a microphone within the wearable device 16 for transmission to a central command station or third party.

For example, the communication controller transceiver 126 transmits and receives signals to and from a transceiver 120 in the bone conduction element transceiver 120 via a wireless communication technology such as BLUETOOTH, infra-red, Zigbee, near field communication (NFC), WiFi, etc. Further, the communication controller 62 includes a power source 146 in communication with the processing circuitry 138 and the communication controller transceiver 126. In one embodiment, the power source is a battery, it being understood that any suitable arrangement for supplying power to drive the electronic components in the communication controller 62 can be used.

Optionally, for bidirectional communications, the communication controller transceiver 126 receives audio signals from the wireless communication unit 122 and wirelessly transmits those signals to a third transceiver or receiver, and/or may record the audio signals without further transmission.

In addition to a traditional processor and memory, processing circuitry 138 may include integrated circuitry for processing and/or control, e.g., one or more processors and/or processor cores and/or FPGAs (Field Programmable Gate Array) and/or ASICs (Application Specific Integrated Circuitry).

Processing circuitry 138 may comprise and/or be connected to and/or be configured for accessing (e.g., writing to and/or reading from) memory 142, which may comprise any kind of volatile and/or non-volatile memory, e.g., cache and/or buffer memory and/or RAM (Random Access Memory) and/or ROM (Read-Only Memory) and/or optical memory and/or EPROM (Erasable Programmable Read-Only Memory). Such memory 142 may be configured to store code executable by control circuitry and/or other data, e.g., data pertaining to communication, e.g., configuration and/or address data of nodes, etc. Processing circuitry 138 may be configured to control any of the methods described herein and/or to cause such methods to be performed, e.g., by processor 140. Corresponding instructions may be stored in the memory 142, which may be readable and/or readably connected to the processing circuitry 138. In other words, processing circuitry 128 may include a controller, which may include a microprocessor and/or microcontroller and/or FPGA (Field-Programmable Gate Array) device and/or ASIC (Application Specific Integrated Circuit) device. It may be considered that processing circuitry 128 includes or may be connected or connectable to memory, which may be configured to be accessible for reading and/or writing by the controller and/or processing circuitry 138.

Figure 11:
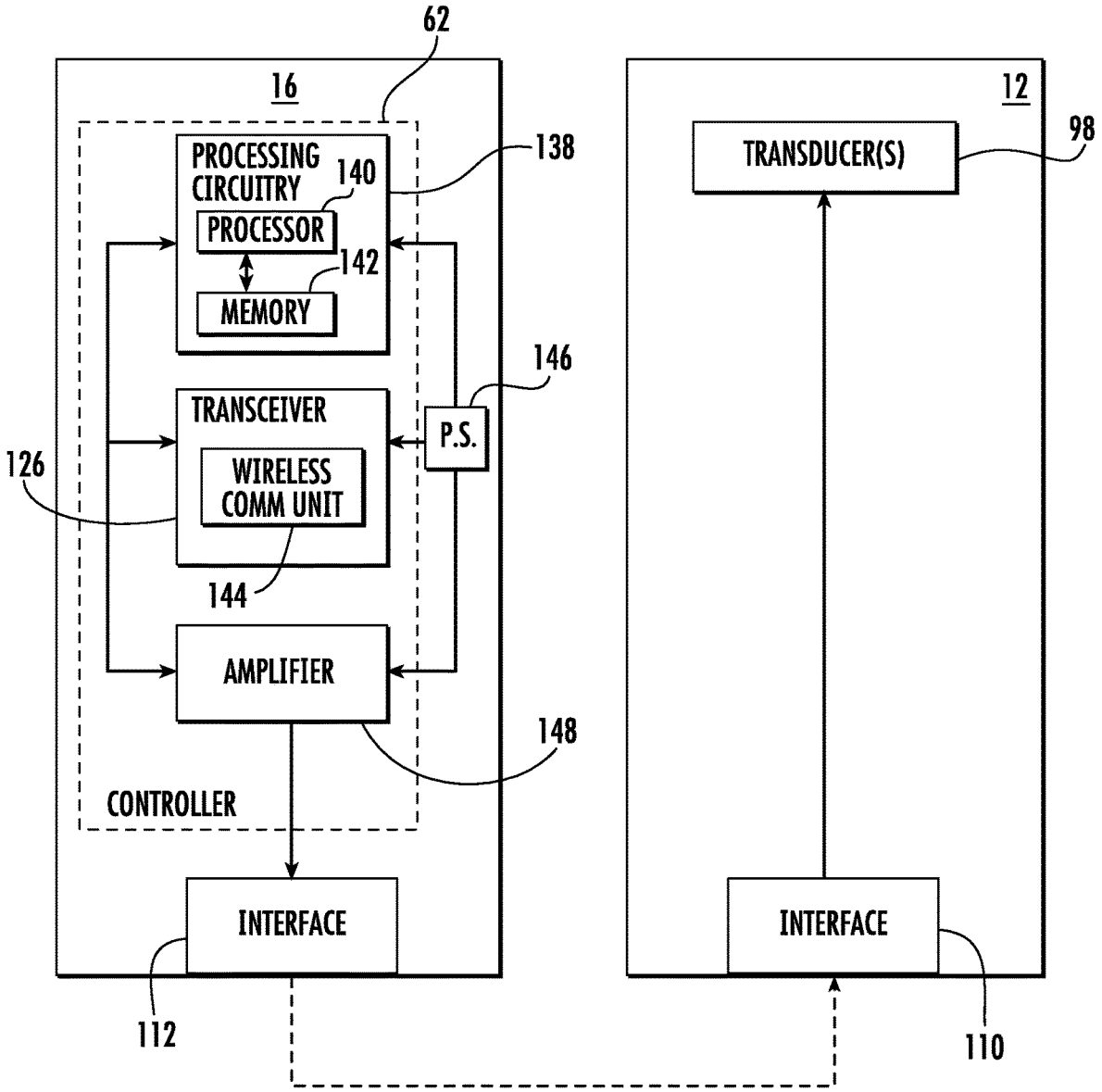
FIG. 11 is a block diagram of electronic components to provide a wired connection between a bone conduction device and a communication controller.

Referring now to FIG. 11, a schematic view of a wired connection between a bone conduction element 12 and the communication controller 62 for unidirectional communication between the wearable device 16 and the bone conduction element 12 is shown. Each bone conduction element 12 includes a bone conduction transducer 98. The bone conduction element housing 64 further includes an interface 110 for a wired connection between the bone conduction element 12 and the communication controller 62. In one embodiment, the interface 110 is a physical interface that allows a wired connection to be established between the bone conduction element 12 and the wearable device 16.

The communication controller housing 22 includes a communication controller 62 that includes processing circuitry 138 having a processor 140 and a memory 142, the functions of which are described above. In one embodiment, the communication controller transceiver 126 may wirelessly receive audio signals from a microphone within the wearable device 16. The communication controller 62 may also include an amplifier 148 in communication with the processing circuitry 138 and communication controller transceiver 126. In this embodiment, the amplifier 148 amplifies the audio signal received by the communication controller transceiver 126 to a level sufficient to drive the bone conduction transducers 98. The communication controller housing 22 includes an interface 112 for a wired connection between the bone conduction element 12 and the communication controller 62.

In use, each bone conduction element transceiver 120 receives signals from the communication controller transceiver 126 through the wired connection between the communication controller housing interface 112 and bone conduction element housing interface 110. Signals sent from the communication controller 62 are amplified by the amplifier 148 after optionally being processed by the processing circuitry 138 before being transmitted to the bone conduction transducer 98. At the bone conduction transducer 98, the signals are converted to mechanical vibrations, which then pass through the wearer's skull bones to the inner ear. In the case of an embodiment supporting bidirectional communication (not shown) based on FIG. 11, it is understood that circuitry is added to allow bidirectional communications in a manner that provides sufficient signal level from the communication controller 62 to the bone conduction element 12 to drive the bone conduction transducer(s) 98, while also allowing the low signal level captured by the bone conduction transducer(s) 98 to be transmitted to the communication controller 62 for processing by the processing circuitry 138.

Of note, although the term "transceiver" is used herein, it is understood that this term is used for convenience and should not be construed as limiting implementations to a single communication element, e.g., integrated circuit, that includes both a transmitter and a receiver. It is understood that a physically separate transmitter and receiver can be used.

The invention advantageously provides a method and system for a bone conduction communication system that includes at least one bone conduction element that is stabilized against a wearer's head when in use. In one embodiment, the bone conduction communication system 5 includes a bone conduction device 10 including at least one bone conduction element 12 and a wearable device 16, the bone conduction element 12 being coupled to the wearable device 16, the wearable device 16 stabilizing the at least one bone conduction element 12 in a plurality of axes of support. In an aspect of this embodiment, the at least one bone conduction element 12 includes a first bone conduction element 12*a* being coupled to a first location on the wearable device 16 and a second bone conduction element 12*b* being coupled to a second location on the wearable device 16. In one embodiment, the wearable device 16 is a respirator mask. In an aspect of this embodiment, the wearable device includes a plurality of strap coupling elements. In an aspect of this embodiment, the wearable device 16 includes a face engagement seal 32, the face engagement seal 32 including the plurality of strap coupling elements 40. In an aspect of this embodiment, the wearable device 16 includes a first strap coupling element 40*a* and a second strap coupling element 40*b*, the first bone conduction element 12*a* being coupled to the first strap coupling element 40*a* and the second bone conduction element 12*b* being coupled to the second strap coupling element 40*b*. In an aspect of this embodiment, the first bone conduction element 12*a* has a first housing 64*a* with a first surface 84 and a second surface 80, and the second bone conduction element 12*b* has a second housing 64*b* with a first surface 92 and a second surface 88, the second surface 80, 88 of each of the first 64*a* and second 64*b* bone conduction element housings having a strap engagement element 66*a*, 66*b* that protrudes from the second surface 80, 88 of each of the first 64*a* and second 64*b* bone conduction element housings. In an aspect of this embodiment, each of the first 40*a* and second 40*b* strap coupling elements has a first surface 82, 90, a second surface, and an aperture 100. The first surface 82 of the first strap coupling element 40*a* is in contact with the second surface 80 of the first bone conduction element housing 64*a* such that the strap engagement element 66*a* of the first bone conduction element housing 64*a* extends through the aperture 100 of the first strap coupling element 40*a*, and the first surface 90 of the second strap coupling element 40*b* is in contact with the second surface 88 of the second bone conduction element housing 64*b* such that the strap engagement element 66*b* of the second bone conduction element housing 64*b* extends through the aperture 100 of the second strap coupling element 40*b*.

In an aspect of this embodiment, the bone conduction communication system 5 further includes a band 36 having a first end 74 and a second end 76 opposite the first end 74, the first bone conduction element 12*a* being coupled to the first end 74 of the band 36 and the second bone conduction element 12*b* being coupled to the second end 76 of the band 36. In an aspect of this embodiment, the wearable device 16 further includes a facepiece 20 and a facepiece seal 24 proximate the face engagement seal 32, the band 36 being located between the facepiece seal 24 and the face engagement seal 32. In an aspect of this embodiment, the wearable device 16 further includes a first strap coupling element 40*a* and a second strap coupling element 40*b*, at least a portion of the first bone conduction element 12*a* being located within the first strap coupling element 40*a* and at least a portion of the second bone conduction element 12*b* being located within the second strap coupling element 40*b*. In an aspect of this embodiment, the first strap coupling element 40*a* defines a first pocket 114*a* and the second strap coupling element 40*b* defines a second pocket 114*b*, the at least a portion of the first bone conduction element 12*a* being located within the first pocket 114*a* and the at least a portion of the second bone conduction element 12*b* being located within the second pocket 114*b*. In an aspect of this embodiment, the wearable device 16 further includes a facepiece 20 and a communication controller housing 22 coupled to the facepiece 20, the communication controller housing 22 including a communication controller 62, the communication controller 62 having processing circuitry 128 having a processor 130 and a memory 132 and a communication controller transceiver 126 having a communication unit 144, the communication controller 62 being in electrical communication with the bone conduction device 10. In an aspect of this embodiment, at least one of the first 12*a* and second 12*b* bone conduction elements further includes processing circuitry 128 having a processor 130 and a memory 132, an amplifier 134, and a transceiver 120 having a communication unit 122, the at least one of the first 12*a* and second 12*b* bone conduction element being in communication with the communication controller 62. In an aspect of this embodiment, the communication unit 122 is a wireless communication unit.

In one embodiment, a bone conduction communication system 5 includes a wearable device 16 having a first strap coupling element 40*a* on a first side of the wearable device 16 and a second strap coupling element 40*b* on the second side of the wearable device 16; a first bone conduction element 12*a* including: a first bone conduction transducer 98; a first processing circuitry 128 having a processor 130 and a memory 132, the first processing circuitry 128 being in electrical communication with the first bone conduction transducer 98; a first transceiver 120 having a communication unit 122, the first transceiver 120 being in communication with the first processing circuitry 128; a first amplifier 134 in communication with the first transceiver 120 and the first bone conduction transducer 98; and a first power source 136 in communication with the first amplifier 134, the first transceiver 120, and the first processing circuitry 128; a second bone conduction element 12*b* including: a second bone conduction transducer 98; a second processing circuitry 128 having a processor 130 and a memory 132, the second processing circuitry 128 being in communication with the second bone conduction transducer 98; a second transceiver 120 having a communication unit 122, the second transceiver 120 being in communication with the second processing circuitry 128; a second amplifier 134 in communication with the second transceiver 120 and the second transducer 98; and a second power source 136 in communication with the second amplifier 134, the second transceiver 120, and the second processing circuitry 128; and a band 36 having a first end 74 and a second end 76 opposite the first end 74, the first bone conduction element 12*a* being at the first end 74 and the second bone conduction element 12*b* being at the second end 76, the band 36 being coupled to the wearable device 16 such that the first bone conduction element 12*a* is coupled to the first strap coupling element 40*a* and the second bone conduction element 12*b* is coupled to the second strap coupling element 40*b*, each of the first 12*a* and second 12*b* bone conduction elements being stabilized by the band 36 and the wearable device 16 along a plurality of axes of support. In an aspect of this embodiment, the first bone conduction element 12*a* is coupled to a first location on the wearable device 16 and the second bone conduction element 12*b* is coupled to a second location on the wearable device 16. In an aspect of this embodiment, the wearable device 16 is coupled to a helmet. In an aspect of this embodiment, the wearable device 16 includes a facepiece 20 and a communication controller, the communication controller and the band 36 being coupled to the facepiece 20. In an aspect of this embodiment, the wearable device 16 includes a facepiece 20, a communication controller 62 coupled to the facepiece 20, a first seal 24 coupled to the facepiece 20, and a face engagement seal 32 coupled to the facepiece 20 proximate the first seal 24, the band 36 being located between the first seal 24 and the face engagement seal 32.

In one embodiment, a bone conduction communication system 5 includes a wearable device 16 including a facepiece 20, a communication controller 62, the communication controller 62 having a processing circuitry 138, the processing circuitry 138 having a processor 140 and a memory 142, and a face engagement seal 32 coupled to the facepiece 20, the face engagement seal 32 including at least one strap coupling element 40, and at least one bone conduction transducer 98 within the at least one strap coupling element 40, the at least one bone conduction transducer 98 being stabilized by the at least one strap coupling element 40 along a plurality of axes of support, the at least one bone conduction transducer 98 configured for electrical communication with the communication controller 62. In an aspect of this embodiment, the bone conduction communication system 5 further includes a helmet configured to be worn on a wearer's head, at least a portion of the wearable device 16 being configured to be located between the helmet and the wearer's head. In an aspect of this embodiment, the at least one bone conduction transducer 98 includes a first bone conduction transducer 98 and a second bone conduction transducer 98, at least one of the first and second bone conduction transducers 98 being electrically coupled to a transceiver 120, the transceiver 120 being in wireless communication with the communication controller 62. In an aspect of this embodiment, the at least one strap coupling element 40 includes a first strap coupling element 40*a* defining a first pocket 114*a* and a second strap coupling element 40*b* defining a second pocket 114*b*, the first bone conduction transducer 98 being located within the first pocket 114*a* and the second bone conduction transducer 98 being located within the second pocket 114*b*.

Additional configurations of the bone conduction device and communication controller are also contemplated. For example, each of a plurality of bone conduction elements may include a transducer, whereas only one or fewer than all of the plurality of bone conduction elements may include the other components. In this way, the bone conduction elements may share processing circuitry, an amplifier, a power source, and a transceiver. Additionally, the bone conduction device elements other than the transducer(s) may be included in a separate housing that is in wired or wireless communication with the bone conduction elements and in wired or wireless communication with the communication controller, as described above.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the scope of the embodiment will be apparent to those of skill in the art upon reviewing the above description. In the appended embodiment, the terms "including" and "in which" are used as the plain-English equivalents of the respective terms "comprising" and "wherein." Moreover, in the following embodiments, the terms "first," "second," and "third," etc. are used merely as labels, and are not intended to impose numerical requirements on their objects.

Different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the invention is not limited to what has been particularly shown and described herein above. In addition, unless mention was made above to the contrary, it should be noted that all of the accompanying drawings are not to scale. A variety of modifications and variations are possible in light of the above teachings without departing from the scope of the invention.

What is claimed is:

1. A bone conduction communication system, the bone conduction communication system comprising:

a bone conduction device including at least one bone conduction element;

a wearable device coupled to the bone conduction device, the wearable device having a facepiece, a face engagement seal, and a facepiece seal proximate the face engagement seal, the face engagement seal and facepiece seal collectively forming a fluid-tight seal, the wearable device stabilizing the at least one bone conduction element in a plurality of axes of support; and a band being located between the facepiece seal and face engagement seal, the bone conduction device being coupled to the band.

2. The bone conduction communication system of claim 1, wherein the at least one bone conduction element includes a first bone conduction element being coupled to a first location on the wearable device and a second bone conduction element being coupled to a second location on the wearable device.

3. The bone conduction communication system of claim 2, wherein the wearable device is a respirator mask.

4. The bone conduction communication system of claim 2, wherein the wearable device includes a plurality of strap coupling elements.

5. The bone conduction communication system of claim 4, wherein the face engagement seal includes the plurality of strap coupling elements.

6. The bone conduction communication system of claim 5, wherein the wearable device includes a first strap coupling element and a second strap coupling element, the first bone conduction element being coupled to the first strap coupling element and the second bone conduction element being coupled to the second strap coupling element.

7. The bone conduction communication system of claim 6, wherein the first bone conduction element has a first housing with a first surface and a second surface, and the second bone conduction element has a second housing with a first surface and a second surface, the second surface of each of the first and second bone conduction element housings having a strap engagement element that protrudes from the second surface of each of the first and second bone conduction element housing.

8. The bone conduction communication system of claim 7, wherein each of the first and second strap coupling elements has a first surface a second surface, and an aperture;

the first surface of the first strap coupling element being in contact with the second surface of the first bone conduction element housing such that the strap engagement element of the first bone conduction element housing extends through the aperture of the first strap coupling element; and the first surface of the second strap coupling element being in contact with the second surface of the second bone conduction element housing such that the strap engagement element of the second bone conduction element housing extends through the aperture of the second strap coupling element.

9. The bone conduction communication system of claim 8, further comprising a band having a first end and a second end opposite the first end, the first bone conduction element being coupled to the band first end and the second bone conduction element being coupled to the band second end.

10. The bone conduction communication system of claim 5, wherein the wearable device further includes a first strap coupling element and a second strap coupling element, at least a portion of the first bone conduction element being located within the first strap coupling element and at least a portion of the second bone conduction element being located within the second strap coupling element.

11. The bone conduction communication system of claim 10, wherein the first strap coupling element defines a first pocket and the second strap coupling element defines a second pocket, the at least a portion of the first bone conduction element being located within the first pocket and the at least a portion of the second bone conduction element being located within the second pocket.

12. The bone conduction communication system of claim 8, wherein the wearable device further includes a communication controller housing coupled to the facepiece, the communication controller housing including a communication controller, the communication controller having:

processing circuitry having a processor and a memory; and a communication controller transceiver having a communication unit; and the communication controller being in electrical communication with the bone conduction device.

13. The bone conduction communication system of claim 12, wherein at least one of the first and second bone conduction elements further includes:

processing circuitry having a processor and a memory;

an amplifier; and a transceiver having a communication unit, the at least one of the first and second bone conduction element being in communication with the communication controller.

14. The bone conduction communication system of claim 13, wherein the communication unit is a wireless communication unit.

15. A bone conduction communication system, the bone conduction communication system comprising:

a wearable device having:

a first strap coupling element on a first side of the wearable device and a second strap coupling element on a second side of the wearable device; and a facepiece, a face engagement seal, and a facepiece seal proximate the face engagement seal, the face engagement seal and facepiece seal collectively forming a fluid-tight seal, a first bone conduction element including:

a first bone conduction transducer;

a first processing circuitry having a processor and a memory, the first processing circuitry being in electrical communication with the first bone conduction transducer;

a first transceiver having a communication unit, the first bone conduction transducer being in communication with the first processing circuitry;

a first amplifier in communication with the first transceiver and the first bone conduction transducer; and a first power source in communication with the first amplifier, the first transceiver, and the first processing circuitry;

a second bone conduction element including:

a second bone conduction transducer;

a second processing circuitry having a processor and a memory, the second processing circuitry being in communication with the second bone conduction transducer;

a second transceiver having a communication unit, the second transceiver being in communication with the second processing circuitry;

a second amplifier in communication with the second transceiver and the second bone conduction transducer; and a second power source in communication with the second amplifier, the second transceiver, and the second processing circuitry; and a band being located between the facepiece seal and face engagement seal, the bone conduction device being coupled to the band, the band having a first end and a second end opposite the first end, the first bone conduction element being at the first end and the second bone conduction element being at the second end, the band being coupled to the wearable device such that the first bone conduction element is coupled to the first strap coupling element and the second bone conduction element is coupled to the second strap coupling element, each of the first and second bone conduction elements being stabilized by the band and the wearable device along a plurality of axes of support.

16. The bone conduction communication system of claim 15, wherein the first bone conduction element is coupled to a first location on the wearable device and the second bone conduction element is coupled to a second location on the wearable device.

17. The bone conduction communication system of claim 16, wherein the wearable device is coupled to a helmet.

18. A bone conduction communication system, the bone conduction communication system comprising:

a wearable device including:

a facepiece;

a facepiece seal;

a communication controller, the communication controller having a processing circuitry, the processing circuitry having a processor and a memory; and a face engagement seal coupled to the facepiece, the face engagement seal including at least one strap coupling element;

the face engagement seal and the facepiece seal collectively forming a fluid-tight seal;

a band being located between the facepiece seal and face engagement seal, at least one bone conduction transducer within the at least one strap coupling element, the at least one bone conduction transducer being stabilized by the at least one strap coupling element along a plurality of axes of support, the at least one bone conduction transducer configured for electrical communication with the communication controller.

19. The bone conduction communication system of claim 18, further comprising a helmet configured to be worn on a wearer's head, at least a portion of the wearable device being configured to be located between the helmet and the wearer's head.

* * * * *